US010249253B2

(12) United States Patent
Lee et al.

(10) Patent No.: US 10,249,253 B2
(45) Date of Patent: Apr. 2, 2019

(54) DISPLAY PANEL CONTROLLER TO CONTROL FRAME SYNCHRONIZATION OF A DISPLAY PANEL BASED ON A MINIMUM REFRESH RATE AND DISPLAY DEVICE INCLUDING THE SAME

(71) Applicant: SAMSUNG ELECTRONICS CO., LTD., Suwon-si, Gyeonggi-do (KR)

(72) Inventors: Jong-Hyup Lee, Yangcheon-Gu (KR); Kyoung-Man Kim, Suwon-Si (KR); Jong-Ho Roh, Yongin-Si (KR)

(73) Assignee: SAMSUNG ELECTRONICS CO., LTD., Suwon-si, Gyeonggi-Do (KR)

( * ) Notice: Subject to any disclaimer, the term of this patent is extended or adjusted under 35 U.S.C. 154(b) by 4 days.

(21) Appl. No.: 14/837,684

(22) Filed: Aug. 27, 2015

(65) Prior Publication Data

US 2016/0063939 A1 Mar. 3, 2016

(30) Foreign Application Priority Data

Aug. 27, 2014 (KR) ..... 10-2014-0112085

(51) Int. Cl.
*G09G 3/36* (2006.01)

(52) U.S. Cl.
CPC ... *G09G 3/3648* (2013.01); *G09G 2300/0404* (2013.01); *G09G 2340/0435* (2013.01)

(58) Field of Classification Search
None
See application file for complete search history.

(56) References Cited

U.S. PATENT DOCUMENTS

| | | | | |
|---|---|---|---|---|
| 6,363,212 | B1 | 3/2002 | Fujinami et al. | |
| 6,842,485 | B2 | 1/2005 | Monda et al. | |
| 8,390,613 | B2 | 3/2013 | Park et al. | |
| 8,542,221 | B1 * | 9/2013 | Wyatt | G06F 15/00 345/204 |
| 8,704,819 | B2 | 4/2014 | Ogawa et al. | |
| 2004/0239677 | A1 * | 12/2004 | Mutanen | G06F 3/14 345/545 |
| 2009/0023482 | A1 | 1/2009 | Koura et al. | |
| 2010/0128044 | A1 * | 5/2010 | Yu | G09G 5/393 345/545 |
| 2012/0146968 | A1 * | 6/2012 | Glen | G09G 5/003 345/204 |

(Continued)

FOREIGN PATENT DOCUMENTS

| | | |
|---|---|---|
| JP | 05-150219 | 6/1993 |
| JP | 11-003063 | 1/1999 |

(Continued)

*Primary Examiner* — David D Davis
(74) *Attorney, Agent, or Firm* — F. Chau & Associates, LLC

(57) ABSTRACT

A display panel controller includes a display driver integrated circuit, an application processor, and a synchronization controller. The display driver integrated circuit drives a display panel to display a still image at a predetermined frame rate. The application processor provides the display driver integrated circuit with still image data for implementing the still image and a plurality of control signals generated by a timing controller. The synchronization controller controls synchronization of frames output to the display panel based on a minimum refresh rate of the display panel.

20 Claims, 15 Drawing Sheets

(56) References Cited

U.S. PATENT DOCUMENTS

| | | | | |
|---|---|---|---|---|
| 2012/0229443 | A1* | 9/2012 | Liu | G09G 3/3611 345/212 |
| 2013/0016135 | A1* | 1/2013 | Wang | G09G 3/3233 345/690 |
| 2013/0106872 | A1* | 5/2013 | Peng | G09G 3/20 345/519 |
| 2014/0028657 | A1 | 1/2014 | Kobayashi et al. | |
| 2014/0085280 | A1 | 3/2014 | Saitoh et al. | |
| 2014/0118377 | A1* | 5/2014 | Bae | G09G 5/005 345/545 |
| 2014/0152634 | A1* | 6/2014 | Shibata | G09G 3/3614 345/209 |
| 2014/0253537 | A1* | 9/2014 | Lee | G09G 5/12 345/214 |
| 2015/0087919 | A1* | 3/2015 | Johnson | A61B 5/486 600/301 |

FOREIGN PATENT DOCUMENTS

| | | |
|---|---|---|
| JP | 2002-320198 | 10/2002 |
| JP | 2013-137407 | 7/2013 |

* cited by examiner

DISPLAY PANEL CONTROLLER TO CONTROL FRAME SYNCHRONIZATION OF A DISPLAY PANEL BASED ON A MINIMUM REFRESH RATE AND DISPLAY DEVICE INCLUDING THE SAME

CROSS-REFERENCE TO RELATED APPLICATION(S)

This application claims priority under 35 USC § 119 to Korean Patent Application No. 10-2014-0112085, filed on Aug. 27, 2014 in the Korean Intellectual Property Office (KIPO), the disclosure of which is incorporated by reference in its entirety herein.

BACKGROUND

1. Technical Field

Exemplary embodiments of the inventive concept relate generally to a display device. More particularly, embodiments of the present inventive concept relate to a display panel controller that controls an Indium-Gallium-Zinc-Oxide (IGZO) display panel and a display device including the display panel controller.

2. Discussion of the Related Art

Generally, an electronic device includes a display device for providing visual information to a user, and a liquid crystal display (LCD) device including an LCD panel is widely used as the display device. Recently, an IGZO display panel is an energy-saving type LCD panel that consumes low power when displaying a still image. The IGZO display panel uses Indium-Gallium-Zinc-Oxide thin film transistors. Thus, compared to conventional LCD panels, the IGZO display panel consumes relatively low power because an amount current leakage in the IGZO display panel is relatively small compared to other LCD panels. For example, the IGZO display panel may perform a refresh operation less often than other LCD panels. However, a conventional IGZO display device can be expensive to manufacture.

SUMMARY

At least one embodiment of the inventive concept provides a display panel controller capable of efficiently adjusting (e.g., decreasing) a frame rate of a display panel (e.g., an IGZO display panel), where a central processing unit included in an application processor of the display panel control does not engage in controlling the frame rate of the display panel, and a display driver integrated circuit of the display panel controller does not include a frame memory device.

At least one exemplary embodiment of the inventive concept provides a display device including the display panel controller.

According to an exemplary embodiment of the inventive concept, a display panel controller includes a display driver integrated circuit configured to drive a display panel to display a still image at a predetermined frame rate, an application processor configured to provide the display driver integrated circuit with still image data for implementing the still image and a plurality of control signals generated by a timing controller, and a synchronization controller configured to control a frame synchronization of the display panel based on a minimum refresh rate of the display panel.

In an exemplary embodiment, the display panel controller may further include an image analyzer configured to determine the minimum refresh rate by analyzing the still image data and display characteristics of the display panel.

In an exemplary embodiment, the synchronization controller may be located in the application processor and the image analyzer may be located in the display driver integrated circuit.

In an exemplary embodiment, the image analyzer may provide the synchronization controller with a refresh rate signal indicating the minimum refresh rate. In addition, the synchronization controller may generate a frame start signal by counting a tearing effect control signal output from the display driver integrated circuit based on the minimum refresh rate and may provide the frame start signal to the timing controller.

In an exemplary embodiment, the image analyzer and the synchronization controller may be located in the display driver integrated circuit.

In an exemplary embodiment, the image analyzer may provide the synchronization controller with a refresh rate signal indicating the minimum refresh rate. In addition, the synchronization controller may generate a frame enable signal based on the minimum refresh rate and may provide the frame enable signal as a frame start signal to the timing controller.

In an exemplary embodiment, the image analyzer and the synchronization controller may be located in the application processor.

In an exemplary embodiment, the image analyzer may provide the synchronization controller with a refresh rate signal indicating the minimum refresh rate. In addition, the synchronization controller may generate a frame start signal by counting a tearing effect control signal output from the display driver integrated circuit based on the minimum refresh rate and may provide the frame start signal to the timing controller.

In an exemplary embodiment, the minimum refresh rate may be determined to be a worst refresh rate of the display panel.

In an exemplary embodiment, the synchronization controller may be located in the display driver integrated circuit.

In an exemplary embodiment, the synchronization controller may generate a frame enable signal based on the minimum refresh rate and may provide the frame enable signal as a frame start signal to the timing controller.

In an exemplary embodiment, the synchronization controller may be located in the application processor.

In an exemplary embodiment, the synchronization controller may generate a frame start signal by counting a tearing effect control signal output from the display driver integrated circuit based on the minimum refresh rate and may provide the frame start signal to the timing controller.

According to an exemplary embodiment of the inventive concept, a display device includes an Indium-Gallium-Zinc-Oxide (IGZO) display panel, a display driver integrated circuit, and an application processor. The display driver integrated circuit is configured to drive the IGZO display panel to display a still image at a predetermined frame rate. The application processor is configured to provide the display driver integrated circuit with still image data for implementing the still image and a plurality of control signals. The control signals are generated by a timing controller. The synchronization controller is configured to control a frame synchronization of the IGZO display panel based on a minimum refresh rate of the IGZO display panel.

In an exemplary embodiment, the display device may further include an image analyzer configured to determine the minimum refresh rate by analyzing the still image data and display characteristics of the IGZO display panel.

In an exemplary embodiment, the synchronization controller may be located in the application processor and the image analyzer may be located in the display driver integrated circuit. In addition, the image analyzer may provide the synchronization controller with a refresh rate signal indicating the minimum refresh rate. Furthermore, the synchronization controller may generate a frame start signal by counting a tearing effect control signal output from the display driver integrated circuit based on the minimum refresh rate and may provide the frame start signal to the timing controller.

In an exemplary embodiment, the image analyzer and the synchronization controller may be located in the display driver integrated circuit. In addition, the image analyzer may provide the synchronization controller with a refresh rate signal indicating the minimum refresh rate. Furthermore, the synchronization controller may generate a frame enable signal based on the minimum refresh rate and may provide the frame enable signal as a frame start signal to the timing controller.

In an exemplary embodiment, the image analyzer and the synchronization controller may be located in the application processor. In addition, the image analyzer may provide the synchronization controller with a refresh rate signal indicating the minimum refresh rate. Furthermore, the synchronization controller may generate a frame start signal by counting a tearing effect control signal output from the display driver integrated circuit based on the minimum refresh rate and may provide the frame start signal to the timing controller.

In an exemplary embodiment, the minimum refresh rate may be determined to be a worst refresh rate of the IGZO display panel.

In an exemplary embodiment, the synchronization controller may be located in the display driver integrated circuit. In addition, the synchronization controller may generate a frame enable signal based on the minimum refresh rate and may provide the frame enable signal as a frame start signal to the timing controller.

In an exemplary embodiment, the synchronization controller may be located in the application processor. In addition, the synchronization controller may generate a frame start signal by counting a tearing effect control signal output from the display driver integrated circuit based on the minimum refresh rate and may provide the frame start signal to the timing controller.

According to an exemplary embodiment of the inventive concept, a display panel controller includes an application processor, a display driver integrated circuit, and a synchronization controller. The application processor is configured to provide image data based on a frame start signal and timing control signals. The display driver integrated circuit is configured to determine a minimum refresh rate of a display panel and provide the image data and the timing control signals to the display panel. The synchronization controller is configured to generate the frame start signal based on the determined minimum refresh rate and provide the frame start signal to the application processor.

In an exemplary embodiment, the display driver integrated circuit determines the minimum refresh rate by analyzing still image data within the image data received from the application processor and display characteristics of the display panel. The display characteristics may be characteristics of Indium-Gallium-Zinc-Oxide thin film transistors.

In an exemplary embodiment, the display driver integrated circuit sets the minimum refresh rate to a predefined refresh rate designed to prevent the display panel from showing information from two or more frames in a single screen draw.

In an exemplary embodiment, a central processing unit of the application processor does not engage in controlling the frame rate and the display driver integrated circuit does not include a frame memory device.

A display panel controller according to an exemplary embodiment includes an image analyzer that analyzes a minimum refresh rate of a display panel and a synchronization controller that controls a frame synchronization of the display panel. The image analyzer and the synchronization controller may be included in an application processor. The image analyzer and the synchronization controller may be included in a display driver integrated circuit. The synchronization controller may be included in the application processor or in the display driver integrated circuit. Thus, the display panel controller may efficiently adjust (e.g., decrease) a frame rate of the display panel even though a central processing unit included in the application processor does not engage in controlling the frame rate of the display panel and the display driver integrated circuit does not include a frame memory device.

In addition, a display device including the display panel controller according to at least one exemplary embodiment of the inventive concept may operate at low power by minimizing (or, reducing) power consumption when displaying a still image.

BRIEF DESCRIPTION OF THE DRAWINGS

Exemplary embodiments of the inventive concept will be more clearly understood from the following detailed description in conjunction with the accompanying drawings.

DETAILED DESCRIPTION

Figure 1:
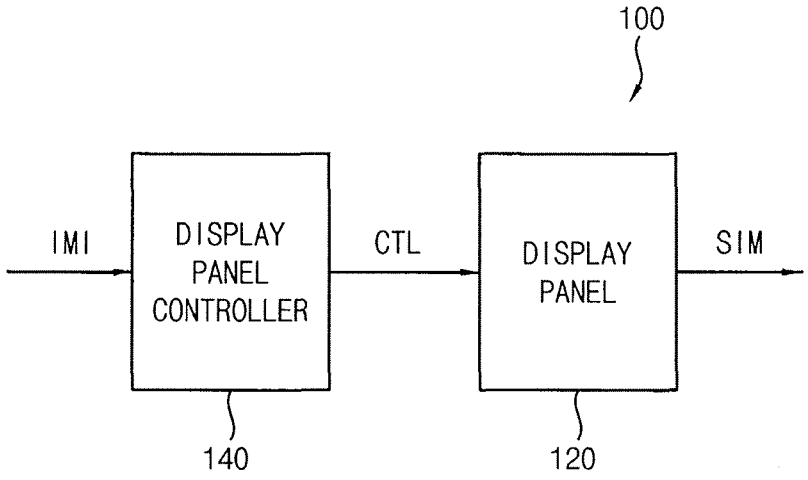
FIG. 1 is a block diagram illustrating a display device according to an exemplary embodiment of the inventive concept.

The inventive concept will be described more fully with reference to the accompanying drawings, in which some exemplary embodiments are shown. The present inventive concept may, however, be embodied in many different forms and should not be construed as limited to the embodiments set forth herein. Rather, these embodiments are provided so that this disclosure will be thorough and complete, and will fully convey the scope of the present inventive concept to those skilled in the art. Like reference numerals refer to like elements throughout this application.

It will be understood that when an element is referred to as being "connected" or "coupled" to another element, it can be directly connected or coupled to the other element or intervening elements may be present. As used herein, the singular forms "a," "an" and "the" are intended to include the plural forms as well, unless the context clearly indicates otherwise.

Figure 2:
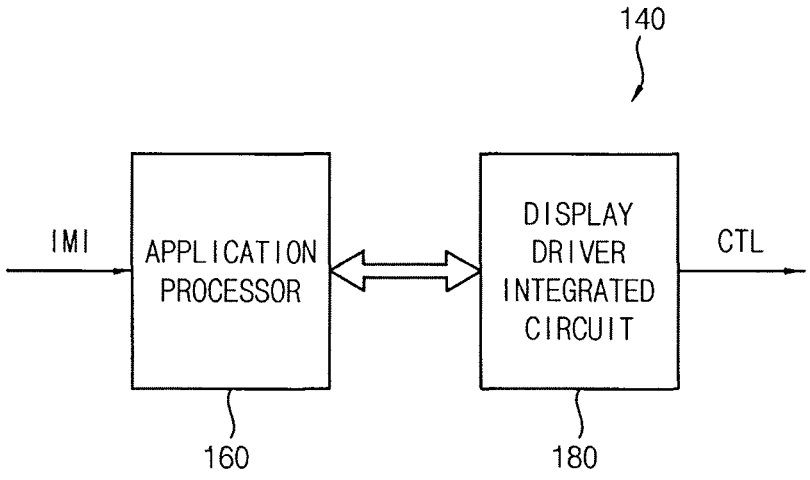
FIG. 2 is a block diagram illustrating a display panel controller included in the display device of FIG. 1 according to an exemplary embodiment of the inventive concept.

FIG. 1 is a block diagram illustrating a display device according to an exemplary embodiment of the inventive concept. FIG. 2 is a block diagram illustrating a display panel controller included in the display device of FIG. 1 according to an exemplary embodiment of the inventive concept.

Referring to FIGS. 1 and 2, the display device 100 includes a display panel 120 and a display panel controller 140. In addition, the display panel controller 140 may include an application processor 160 and a display driver integrated circuit 180.

The display panel 120 may include a plurality of pixels. The display panel 120 may be coupled to the display driver integrated circuit 180 (i.e., a scan driver circuit included in the display driver integrated circuit 180) of the display panel controller 140 via first through (n)th scan-lines, where n is an integer greater than or equal to 2. The display panel 120 may be coupled to the display driver integrated circuit 180 (i.e., a data driver circuit included in the display driver integrated circuit 180) of the display panel controller 140 via first through (m)th data-lines, where m is an integer greater than or equal to 2. Here, since the pixels are placed at locations corresponding to intersecting points of the first through (n)th scan-lines and the first through (m)th data-lines, the display panel 120 may include n×m pixels. In an exemplary embodiment, the display panel 120 is an Indium-Gallium-Zinc-Oxide (IGZO) display panel that uses Indium-Gallium-Zinc-Oxide thin film transistors. In this case, the display panel 120 consumes relatively low power because an amount of current leakage in the IGZO display panel is relatively small compared to other LCD panels. For example, the display panel 120 may perform fewer refresh operations than other LCD panels. Although it is illustrated in FIG. 1 that the display device 100 includes the display panel 120 and the display panel controller 140, the display device 100 may further include other components according to types of the display device 100. For example, the display device 100 may be a liquid crystal display device, an organic light emitting display device, etc.

The display panel controller 140 may receive still image data IMI to display a still image SIM on the display panel 120. In an exemplary embodiment, the display panel controller 140 receives moving image data in addition to the still image data IMI. In an exemplary embodiment, as illustrated in FIG. 2, the display panel controller 140 includes an application processor 160 and the display driver integrated circuit 180. The application processor 160 may provide the display driver integrated circuit 180 with the still image data IMI for implementing the still image SIM and a plurality of control signals CTL generated by a timing controller. The application processor 160 may provide other image data to the display driver integrated circuit 180, such as moving image data. For example, using timing signals such as a vertical synchronization signal, a horizontal synchronization signal, a main clock signal, a data enable signal, etc, the timing controller may generate a data timing control signal for controlling the data driver circuit and a scan timing control signal for controlling the scan (or gate) driver circuit. For example, the data driver circuit provides data signals to data lines of the display panel 120 based on the image data provided by the application processor 160 and the scan driver circuit provides gate signals to gate lines of the display panel. Here, the data timing control signal may include a data start pulse signal, a data sampling clock signal, a data output enable signal, etc. In addition, the scan timing control signal may include a scan start pulse signal, a scan shift clock signal, a scan output enable signal, a shift direction control signal, etc. However, the control signals are not limited thereto. In an exemplary embodiment, the application processor 160 further includes a central processing unit (CPU) that controls an overall operation of the application processor 160.

The display driver integrated circuit 180 may drive the display panel 120 to display the still image SIM at a predetermined frame rate. For this operation, the display driver integrated circuit 120 may include the scan driver circuit and the data driver circuit. The scan driver circuit may provide scan signals to the display panel 120 via the first through (n)th scan-lines. The data driver circuit may provide data signals to the display panel 120 via the first through (m)th data-lines. Here, the scan driver circuit and the data driver circuit of the display driver integrated circuit 180 may be controlled by the control signals provided from the timing controller included in the application processor 160. In an embodiment, the display driver integrated circuit 180 further includes a signal generation circuit for generating a tearing effect control signal. Generally, when the still image SIM is displayed on the display panel 120, the display panel 120 is required to periodically perform a refresh operation even when the still image SIM is not updated. However, since the number of times that the display panel 120 performs the refresh operation can be reduced compared to the other display panels if the display panel 120 is the IGZO display panel, the display device 100 may decrease a frame rate of the display panel 120 when the still image SIM is displayed on the display panel 120. In an exemplary embodiment, after the frame rate has been decreased from a first rate to a second frame rate due to the still image, the frame rate can be increased back to the first rate when a moving image is displayed on the display panel 120.

A frame rate of a display panel may be decreased using a central processing unit included in an application processor to engage in controlling the frame rate of the display panel, and a display driver integrated circuit including a frame memory device that stores still image data for implementing a still image. For example, if the display driver integrated circuit does not include the frame memory device when the still image is displayed on the display panel, the display driver integrated circuit is required to provide a frame synchronization signal to the application processor in order to maintain the frame rate of the display panel. For example, the frame rate could be maintained at 60 frames per second (fps). In this case, the frame synchronization signal should be controlled to decrease the frame rate of the display panel 120, and only the central processing unit included in the application processor can control the frame synchronization signal. However, controlling the frame synchronization signal imposes a burden on the central processing unit and precludes components of the application processor from entering into an idle state, which could lower power consumption. Further, when the display driver integrated circuit is required to include the frame memory device, the cost to manufacture a corresponding display device can be relatively high.

In an exemplary embodiment of the inventive concept, the display device 100 includes a synchronization controller that controls a frame synchronization of the display panel 120 based on a minimum refresh rate of the display panel 120. In an exemplary embodiment, the minimum refresh rate of the display panel 120 is determined by an image analyzer. For example, the display device 100 includes an image analyzer that determines the minimum refresh rate of the display panel 120 by analyzing the still image data IMI and display characteristics of the display panel 120. In an exemplary embodiment, the display characteristics are characteristics of Indium-Gallium-Zinc-Oxide thin film transistors. In an exemplary embodiment, in the display device 100, each of the synchronization controller and the image analyzer is included in the application processor 160 or in the display driver integrated circuit 180. For example, the synchronization controller may be located in the application processor 160, and the image analyzer may be located in the display driver integrated circuit 180. In an exemplary embodiment, the synchronization controller and the image analyzer are located in the display driver integrated circuit 180. In an exemplary embodiment, the synchronization controller and the image analyzer are located in the application processor 160. Here, an interaction between the application processor 160 and the display driver integrated circuit 180 may differ according to where each of the synchronization controller and the image analyzer is located in the display device 100. The interaction between the application processor 160 and the display driver integrated circuit 180 will be described in detail with reference to FIGS. 3 through 14B.

In an exemplary embodiment, the minimum refresh rate of the display panel 120 is determined to be a worst refresh rate of the display panel 120. In this case, the display device 100 does not include the image analyzer. In addition, the display device does not consider (or, use) the display characteristics of the display panel 120 according to the still image data IMI. In an exemplary embodiment of the inventive concept, the minimum refresh rate of the display panel 120 is determined by the central processing unit included in the application processor 160. In this case, the display device 100 does not include the image analyzer. In addition, the central processing unit included in the application processor 160 at least partially engages in controlling the frame rate of the display panel 120. In these exemplary embodiments, the synchronization controller is included in the application processor 160 or in the display driver integrated circuit 180. As described above, the interaction between the application processor 160 and the display driver integrated circuit 180 may differ according to where the synchronization controller is located in the display device 100. In these exemplary embodiments, the display device 100 does not include the image analyzer. Thus, when the minimum refresh rate of the display panel 120 is determined, the display characteristics of the display panel 120 according to the still image data IMI are not considered. Therefore, an embodiment in which the display device 100 includes both the synchronization controller and the image analyzer may be more effective (or, preferable) than an embodiment in which the display device 100 includes only the synchronization controller.

As described above, the display panel controller 140 may include the image analyzer that analyzes the minimum refresh rate of the display panel 120 and the synchronization controller that controls the frame synchronization of the display panel 120, where each of the image analyzer and the synchronization controller is included in the application processor 160 or in the display driver integrated circuit 180, or may include the synchronization controller that controls the frame synchronization of the display panel 120, where the synchronization controller is included in the application processor 160 or in the display driver integrated circuit 180. Thus, the display panel controller 140 may efficiently adjust (or, decrease) the frame rate of the display panel 120, where the central processing unit included in the application processor 160 does not engage in controlling the frame rate of the display panel 120, and the display driver integrated circuit 180 does not include the frame memory device. As a result, the display device 100 including the display panel controller 140 may operate at low power by minimizing (or, reducing) power consumption when displaying the still image SIM. In an exemplary embodiment, the display panel controller 140 maintains components of the application processor 160 such as the central processing unit in the idle state (i.e., the display panel controller 140 may operate at low power) when performing the refresh operation for the still image SIM displayed on the display panel 120. In other words, the display panel controller 140 does not impose a burden due to the refresh operation for the still image SIM on the central processing unit included in the application processor 160. Hence, the display device 100 may fully take advantage of the low power qualities of the display panel 120 (i.e., the IGZO display panel).

Figure 3:
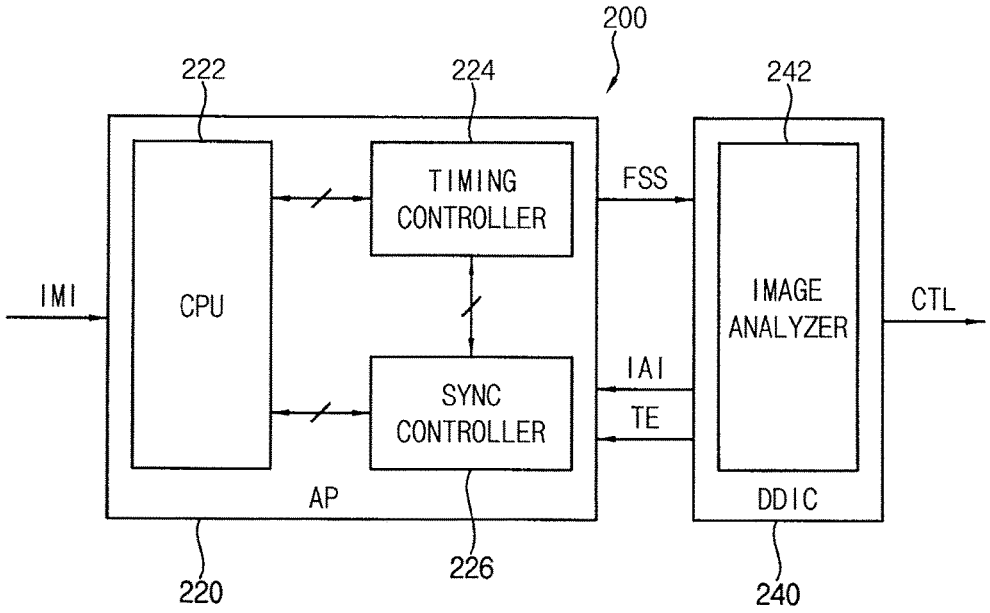
FIG. 3 is a block diagram illustrating an example of the display panel controller of FIG. 2 according to an exemplary embodiment of the inventive concept.
Figure 4:
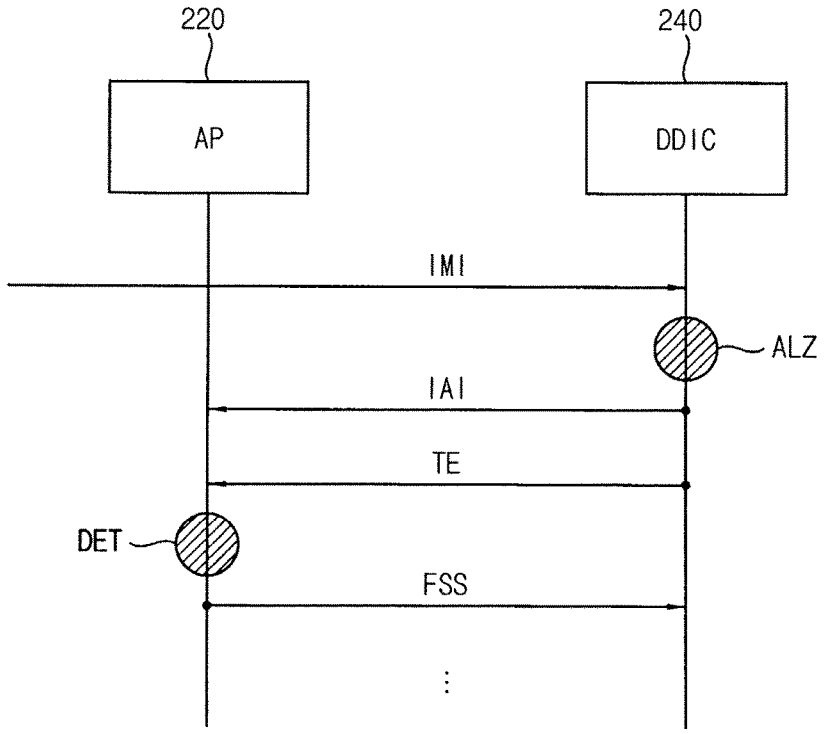
FIG. 4 is a diagram illustrating an example in which a frame rate of a display panel is adjusted by the display panel controller of FIG. 3.
Figure 5:
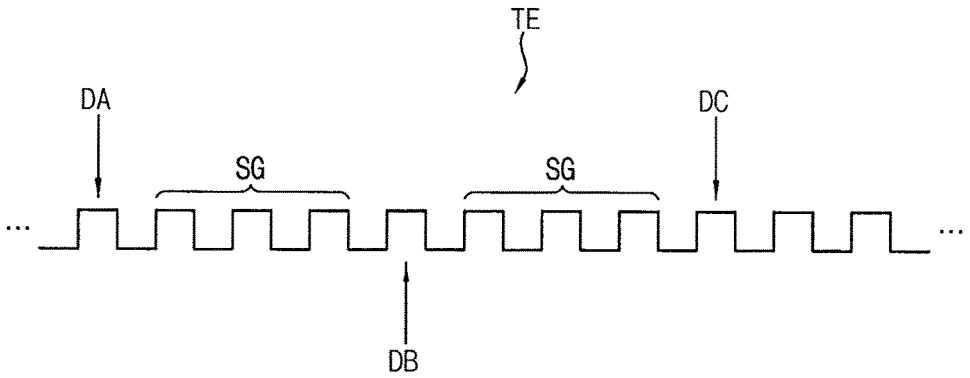
FIG. 5 is a timing diagram illustrating an example in which a frame rate of a display panel is adjusted by the display panel controller of FIG. 3.

FIG. 3 is a block diagram illustrating an example of the display panel controller of FIG. 2 according to an exemplary embodiment of the inventive concept. FIG. 4 is a diagram illustrating an example in which a frame rate of a display panel is adjusted by the display panel controller of FIG. 3. FIG. 5 is a timing diagram illustrating an example in which a frame rate of a display panel is adjusted by the display panel controller of FIG. 3.

Referring to FIGS. 3 through 5, the display panel controller 200 includes an application processor 220 and a display driver integrated circuit 240. Here, the application processor 220 includes a central processing unit 222, a timing controller 224, and a synchronization controller 226. In addition, the display driver integrated circuit 240 includes an image analyzer 242. That is, the synchronization controller 226 may be located in the application processor 220, and the image analyzer 242 may be located in the display driver integrated circuit 240.

The synchronization controller 226 included in the application processor 220 controls a frame synchronization of the display panel based on a minimum refresh rate SG of the display panel. The image analyzer 242 included in the display driver integrated circuit 240 determines the minimum refresh rate SG of the display panel by analyzing the still image data IMI and display characteristics of the display panel. First, the central processing unit 222 controls the still image data IMI to be transferred from an external memory device to the timing controller 224. Thus, the timing controller 224 may provide the still image data IMI to the display driver integrated circuit 240 to display a still image on the display panel. The central processing unit 222 does not engage in controlling a frame rate of the display panel. Specifically, as illustrated in FIG. 4, when the still image data IMI is transferred from the external memory device to the display driver integrated circuit 240 via the application processor 220, the image analyzer 242 included in the display driver integrated circuit 240 determines the minimum refresh rate SG of the display panel by analyzing the still image data IMI and the display characteristics of the display panel (i.e., indicated as ALZ), and then provides a refresh rate signal IAI indicating the minimum refresh rate SG of the display panel to the application processor 220 (i.e., the synchronization controller 226).

In an exemplary embodiment, the display driver integrated circuit 240 further includes a signal generation circuit that generates a tearing effect control signal TE. The display driver integrated circuit 240 may continuously or periodically provide the tearing effect control signal TE to the application processor 220. When the display driver integrated circuit 240 provides the tearing effect control signal TE to the application processor 220, the synchronization controller 226 generates a frame start signal by counting the tearing effect control signal TE based on the minimum refresh rate SG of the display panel (i.e., indicated as DET). For example, as illustrated in FIG. 5, when the display driver integrated circuit 240 provides the tearing effect control signal TE to the application processor 220, the synchronization controller 226 generates the frame start signal by skipping clocks corresponding to the minimum refresh rate SG of the display panel from the tearing effect control signal TE (i.e., indicated as DET). For example, a tearing effect control signal TE of a first number of clock pulses during a period of time may be converted into a frame start signal with a second lower number of pulses during the period, by removing some of the first number of pulses. Thus, the frame start signal may include selected (or, non-skipped) clocks DA, DB, and DC. Subsequently, when the synchronization controller 226 provides the frame start signal to the timing controller 224, the timing controller 224 may provide the still image data IMI to the display driver integrated circuit 240 in synchronization with the frame start signal (i.e., at the minimum refresh rate SG of the display panel). Here, the timing controller 224 may provide the display driver integrated circuit 240 with a plurality of control signals FSS for performing a refresh operation for the still image.

As described above, the display panel controller 200 may include the image analyzer 242 that analyzes the minimum refresh rate SG of the display panel and the synchronization controller 226 that controls a frame synchronization of the display panel. Thus, even though the central processing unit 222 of the application processor 220 does not engage in controlling a frame rate of the display panel and the display driver integrated circuit 240 does not include a frame memory device, the display panel controller 200 may efficiently adjust the frame rate of the display panel. For convenience of description, the application processor 220 and the display driver integrated circuit 240 are simplified in FIGS. 3 through 5. That is, the application processor 220 may include other components as well as the central processing unit 222, the timing controller 224, and the synchronization controller 226. In addition, the display driver integrated circuit 240 may include other components (e.g., a scan driver circuit, a data driver circuit, etc) as well as the image analyzer 242. Therefore, it should be understood that a structure of the display panel controller 200 in which the synchronization controller 226 is located in the application processor 220 and the image analyzer 242 is located in the display driver integrated circuit 240 is not limited to the structure of FIG. 3.

Figure 6:
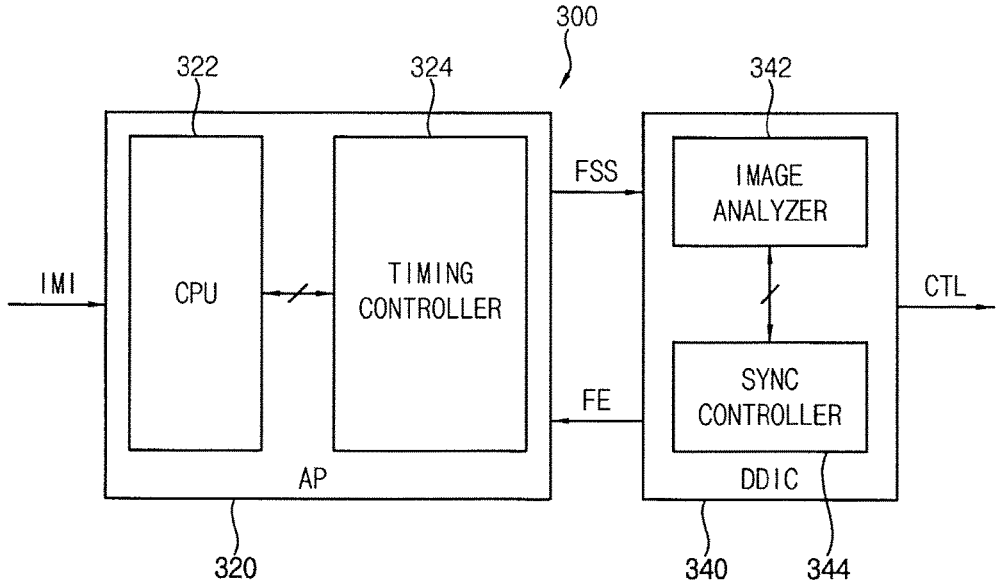
FIG. 6 is a block diagram illustrating another example of the display panel controller of FIG. 2 according to an exemplary embodiment of the inventive concept.
Figure 7:
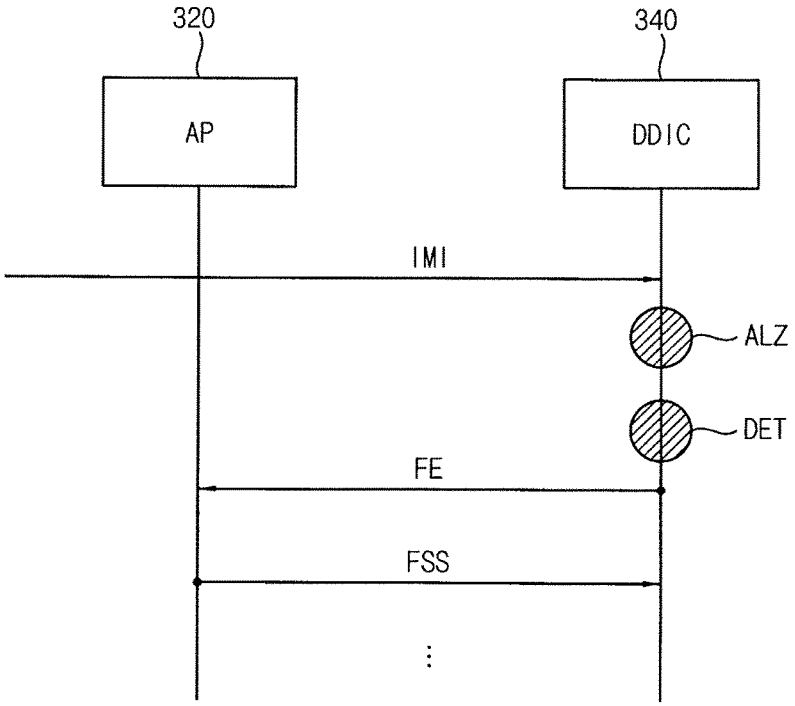
FIG. 7 is a diagram illustrating an example in which a frame rate of a display panel is adjusted by the display panel controller of FIG. 6.
Figure 8:
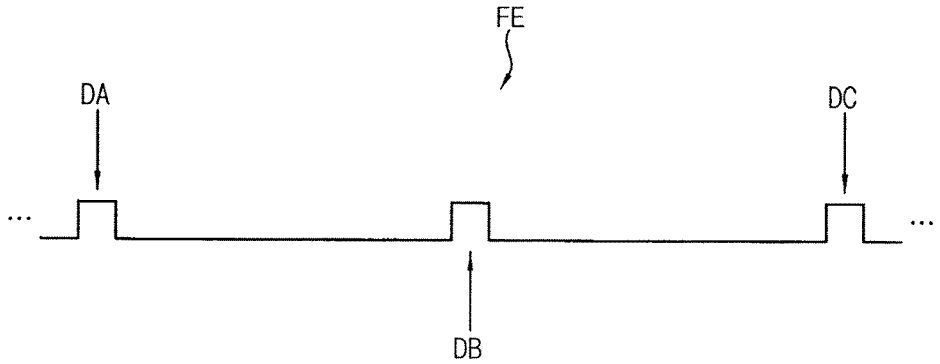
FIG. 8 is a timing diagram illustrating an example in which a frame rate of a display panel is adjusted by the display panel controller of FIG. 6.

FIG. 6 is a block diagram illustrating an example of the display panel controller of FIG. 2 according to an exemplary embodiment of the inventive concept. FIG. 7 is a diagram illustrating an example in which a frame rate of a display panel is adjusted by the display panel controller of FIG. 6. FIG. 8 is a timing diagram illustrating an example in which a frame rate of a display panel is adjusted by the display panel controller of FIG. 6.

Referring to FIGS. 6 through 8, the display panel controller 300 includes an application processor 320 and a display driver integrated circuit 340. Here, the application processor 320 includes a central processing unit 322 and a timing controller 324. In addition, the display driver integrated circuit 340 includes an image analyzer 342 and a synchronization controller 344. That is, the image analyzer 342 and the synchronization controller 344 are located in the display driver integrated circuit 340.

The synchronization controller 344 included in the display driver integrated circuit 340 controls a frame synchronization of the display panel based on a minimum refresh rate of the display panel. The image analyzer 342 included in the display driver integrated circuit 340 determines the minimum refresh rate of the display panel by analyzing the still image data IMI and display characteristics of the display panel. First, the central processing unit 322 may control the still image data IMI to be transferred from an external memory device to the timing controller 324. Thus, the timing controller 324 may provide the still image data IMI to the display driver integrated circuit 340 to display a still image on the display panel. The central processing unit 322 does not engage in controlling a frame rate of the display panel. Specifically, as illustrated in FIG. 7, when the still image data IMI is transferred from the external memory device to the display driver integrated circuit 340 via the application processor 320, the image analyzer 342 included in the display driver integrated circuit 340 determines the minimum refresh rate of the display panel by analyzing the still image data IMI and the display characteristics of the display panel (i.e., indicated as ALZ), and then provides a refresh rate signal indicating the minimum refresh rate (e.g., DET) of the display panel to the synchronization controller 344 included in the display driver integrated circuit 340.

Subsequently, the synchronization controller 344 included in the display driver integrated circuit 340 generates a frame enable signal FE based on the minimum refresh rate of the display panel (i.e., indicated as DET), and provides the frame enable signal FE as a frame start signal to the application processor 320 (i.e., the timing controller 324). As illustrated in FIG. 8, since the frame enable signal FE includes adjacent clocks DA, DB, and DC each being spaced apart from one another by a distance corresponding to the minimum refresh rate of the display panel, the frame enable signal FE may be provided to the timing controller 324 as the frame start signal. For example, the synchronization controller 344 may generate the frame enable signal FE by using a method that is described with reference to FIG. 5 (i.e., by skipping clocks corresponding to the minimum refresh rate of the display panel on a tearing effect control signal. However, a method of generating the frame enable signal FE is not limited thereto. Next, the timing controller 324 included in the application processor 320 provides the still image data IMI to the display driver integrated circuit 340 in synchronization with the frame start signal corresponding to the frame enable signal FE (i.e., at the minimum refresh rate of the display panel). Here, the timing controller 324 provides the display driver integrated circuit 340 with a plurality of control signals FSS for performing a refresh operation for the still image.

As described above, the display panel controller 300 may include the image analyzer 342 that analyzes the minimum refresh rate of the display panel and the synchronization controller 344 that controls a frame synchronization of the display panel. Thus, even though the central processing unit 322 of the application processor 320 does not engage in controlling a frame rate of the display panel and the display driver integrated circuit 340 does not include a frame memory device, the display panel controller 300 may efficiently adjust the frame rate of the display panel. For convenience of description, the application processor 320 and the display driver integrated circuit 340 are simplified in FIGS. 6 through 8. That is, the application processor 320 may include other components as well as the central processing unit 322 and the timing controller 324. In addition, the display driver integrated circuit 340 may include other components (e.g., a scan driver circuit, a data driver circuit, etc) as well as the image analyzer 342 and the synchronization controller 344. Therefore, it should be understood that a structure of the display panel controller 300 in which the image analyzer 342 and the synchronization controller 344 are located in the display driver integrated circuit 340 is not limited to the structure of FIG. 6.

Figure 9:
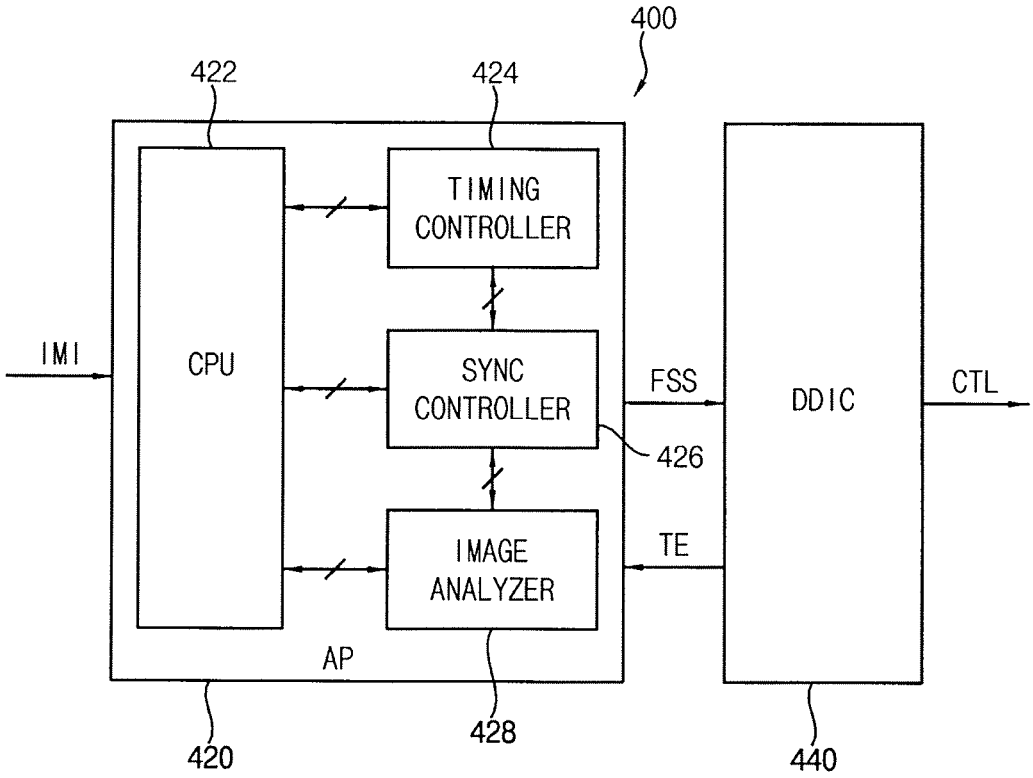
FIG. 9 is a block diagram illustrating an example of the display panel controller of FIG. 2 according to an exemplary embodiment of the inventive concept.
Figure 10:
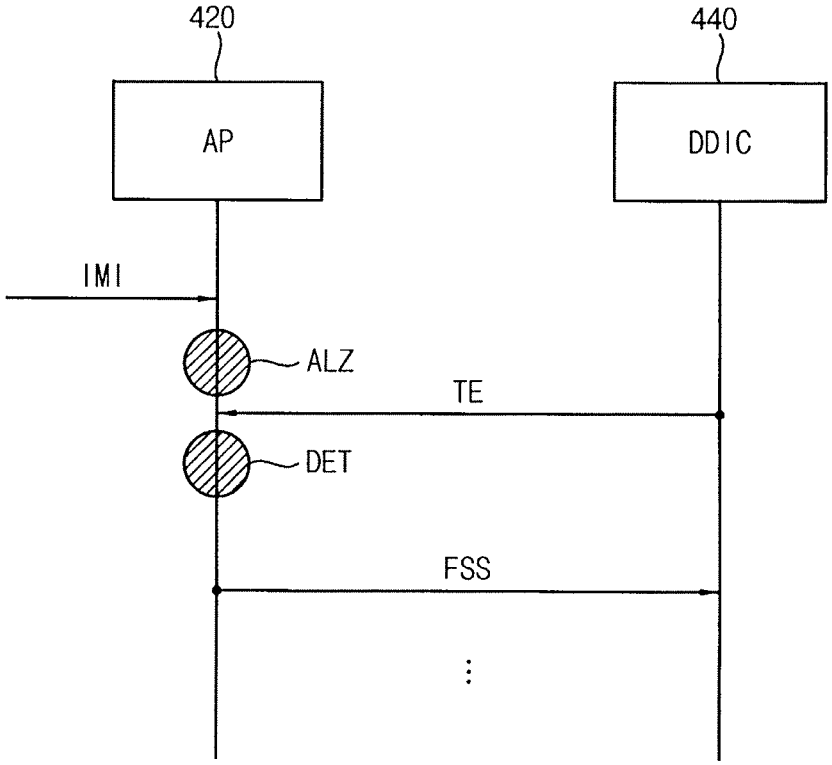
FIG. 10 is a diagram illustrating an example in which a frame rate of a display panel is adjusted by the display panel controller of FIG. 9.

FIG. 9 is a block diagram illustrating an example of the display panel controller of FIG. 2 according to an exemplary embodiment of the inventive concept. FIG. 10 is a diagram illustrating an example in which a frame rate of a display panel is adjusted by the display panel controller of FIG. 9.

Referring to FIGS. 9 and 10, the display panel controller 400 includes an application processor 420 and a display driver integrated circuit 440. Here, the application processor 420 includes a central processing unit 422, a timing controller 424, a synchronization controller 426, and an image analyzer 428. That is, the image analyzer 428 and the synchronization controller 426 are located in the application processor 420.

The synchronization controller 426 included in the application processor 420 controls a frame synchronization of the display panel based on a minimum refresh rate of the display panel. The image analyzer 428 included in the application processor 420 determines the minimum refresh rate of the display panel by analyzing the still image data IMI and display characteristics of the display panel. First, the central processing unit 422 may control the still image data IMI to be transferred from an external memory device to the timing controller 424. Thus, the timing controller 424 may provide the still image data IMI to the display driver integrated circuit 440 to display a still image on the display panel. The central processing unit 422 does not engage in controlling a frame rate of the display panel. Specifically, as illustrated in FIG. 10, when the still image data IMI is transferred from the external memory device to the application processor 420, the image analyzer 428 included in the application processor 420 determines the minimum refresh rate of the display panel by analyzing the still image data IMI and the display characteristics of the display panel (i.e., indicated as ALZ), and then provides a refresh rate signal indicating the minimum refresh rate of the display panel to the synchronization controller 426 included in the application processor 420.

Next, the synchronization controller 426 included in the application processor 420 generates a frame start signal by counting a tearing effect control signal TE output from the display driver integrated circuit 440 based on the minimum refresh rate of the display panel (i.e., indicated as DET). For example, when the display driver integrated circuit 440 provides the tearing effect control signal TE to the application processor 420, the synchronization controller 426 may generate the frame start signal by skipping (e.g., omitting or removing) clocks corresponding to the minimum refresh rate of the display panel on the tearing effect control signal TE (i.e., indicated as DET). Subsequently, when the synchronization controller 426 provides the frame start signal to the timing controller 424 in the application processor 420, the timing controller 424 may provide the still image data IMI to the display driver integrated circuit 440 in synchronization with the frame start signal (i.e., at the minimum refresh rate of the display panel). Here, the timing controller 424 may provide the display driver integrated circuit 440 with a plurality of control signals FSS for performing a refresh operation for the still image.

As described above, the display panel controller 400 may include the image analyzer 428 that analyzes the minimum refresh rate of the display panel and the synchronization controller 426 that controls a frame synchronization of the display panel. Thus, even though the central processing unit 422 of the application processor 420 does not engage in controlling a frame rate of the display panel and the display driver integrated circuit 440 does not include a frame memory device, the display panel controller 400 may efficiently adjust the frame rate of the display panel. For convenience of description, the application processor 420 and the display driver integrated circuit 440 are simplified in FIGS. 9 and 10. That is, the application processor 420 may include other components as well as the central processing unit 422, the timing controller 424, the synchronization controller 426, and the image analyzer 428. In addition, the display driver integrated circuit 440 may include a scan driver circuit, a data driver circuit, etc. Therefore, it should be understood that a structure of the display panel controller 400 in which the image analyzer 428 and the synchronization controller 426 are located in the application processor 420 is not limited to the structure of FIG. 9.

Figure 11:
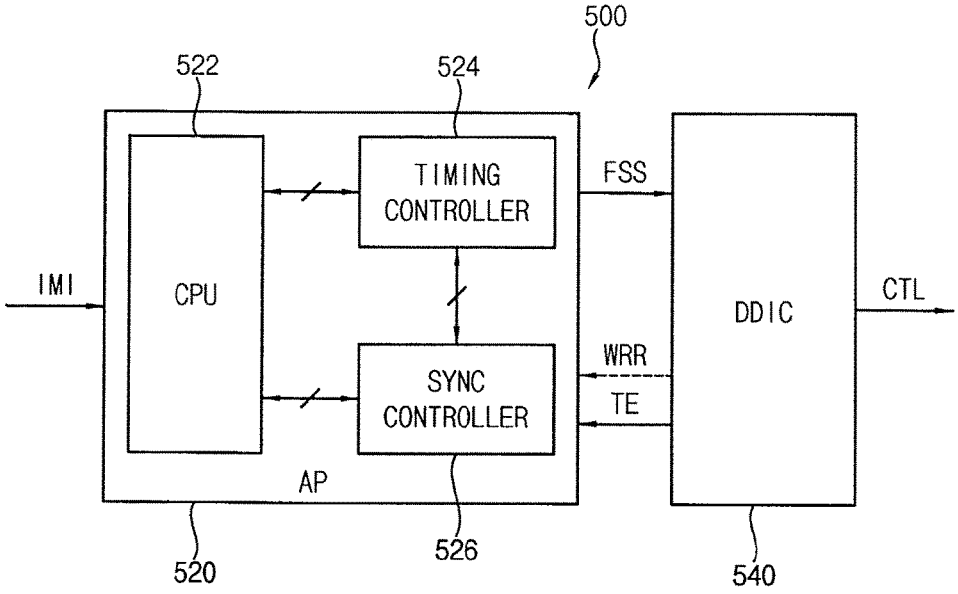
FIG. 11 is a block diagram illustrating an example of the display panel controller of FIG. 2 according to an exemplary embodiment of the inventive concept.
Figure 12A:
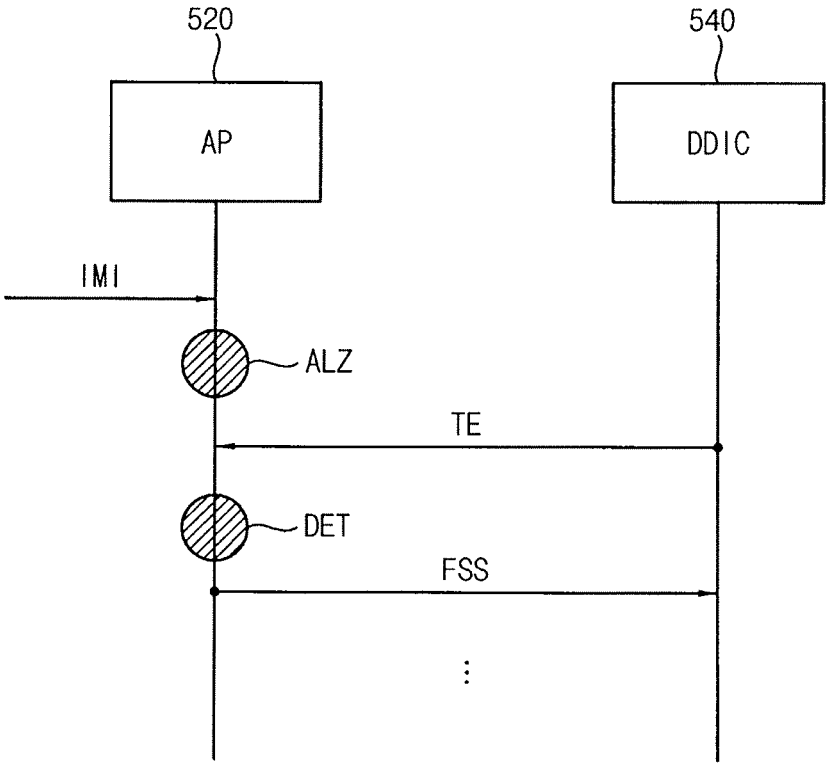
FIG. 12A is a diagram illustrating an example in which a frame rate of a display panel is adjusted by the display panel controller of FIG. 11.
Figure 12B:
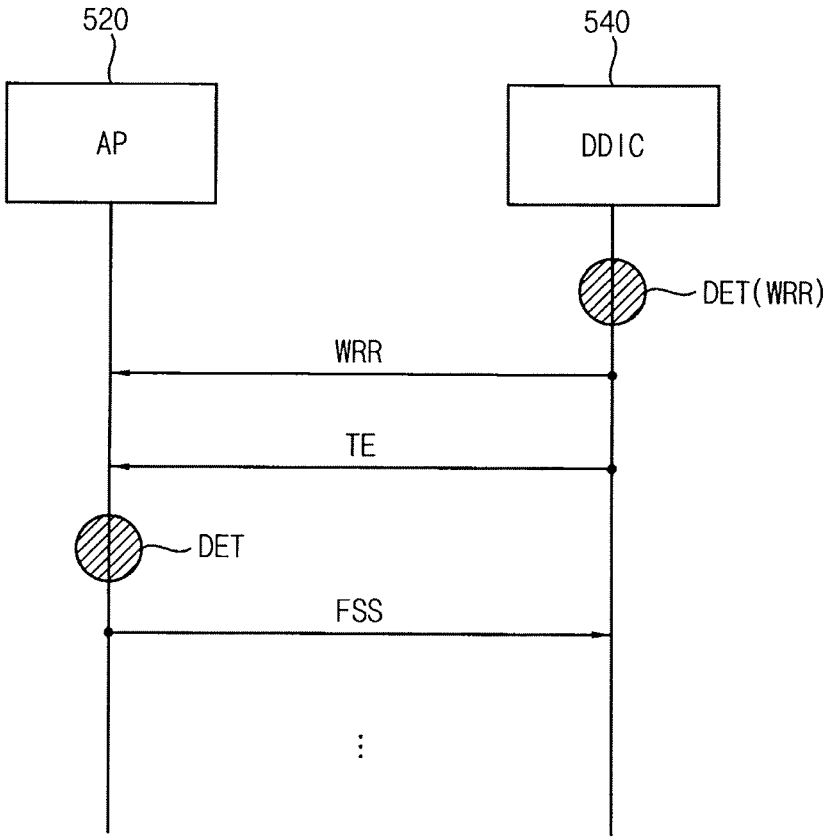
FIG. 12B is a diagram illustrating an example in which a frame rate of a display panel is adjusted by the display panel controller of FIG. 11.

FIG. 11 is a block diagram illustrating an example of the display panel controller of FIG. 2 according to an exemplary embodiment of the inventive concept. FIG. 12A is a diagram illustrating an example in which a frame rate of a display panel is adjusted by the display panel controller of FIG. 11. FIG. 12B is a diagram illustrating an example in which a frame rate of a display panel is adjusted by the display panel controller of FIG. 11.

Referring to FIGS. 11 through 12B, the display panel controller 500 includes an application processor 520 and a display driver integrated circuit 540. Here, the application processor 520 includes a central processing unit 522, a timing controller 524, and a synchronization controller 526. That is, the synchronization controller 526 is located in the application processor 520.

The synchronization controller 526 included in the application processor 520 controls a frame synchronization of the display panel based on a minimum refresh rate of the display panel. In exemplary embodiment, the display panel controller 500 does not include an image analyzer that determines the minimum refresh rate of the display panel by analyzing the still image data IMI and display characteristics of the display panel. Thus, the minimum refresh rate of the display panel is determined to be a worst refresh rate of the display panel. The worst refresh rate may be the lowest refresh rate that is recommended by a manufacturer for an IGZO display. Alternatively, the minimum refresh rate of the display panel may be determined by the central processing unit 522 included in the application processor 520. First, the central processing unit 522 may control the still image data IMI to be transferred from an external memory device to the timing controller 524. Thus, the timing controller 524 may provide the still image data IMI to the display driver integrated circuit 540 to display a still image on the display panel.

In an exemplary embodiment, as illustrated in FIG. 12A, when the still image data IMI is transferred from the external memory device to the application processor 520, the central processing unit 522 included in the application processor 520 determines the minimum refresh rate of the display panel by analyzing the still image data IMI and the display characteristics of the display panel (i.e., indicated as ALZ), and then provides a refresh rate signal indicating the minimum refresh rate of the display panel to the synchronization controller 526 included in the application processor 520. Next, the synchronization controller 526 included in the application processor 520 generates a frame start signal by counting a tearing effect control signal TE output from the display driver integrated circuit 540 based on the minimum refresh rate of the display panel (i.e., indicated as DET). Subsequently, when the synchronization controller 526 provides the frame start signal to the timing controller 524 in the application processor 520, the timing controller 524 may provide the still image data IMI to the display driver integrated circuit 540 in synchronization with the frame start signal (i.e., at the minimum refresh rate of the display panel). Here, the timing controller 524 may provide the display driver integrated circuit 540 with a plurality of control signals FSS for performing a refresh operation for the still image.

In an exemplary embodiment, as illustrated in FIG. 12B, the minimum refresh rate of the display panel is determined to be the worst refresh rate of the display panel (i.e., indicated as DET(WRR)). Thus, the display driver integrated circuit 540 provides a refresh rate signal WRR indicating the worst refresh rate of the display panel to the synchronization controller 526 included in the application processor 520. Next, the synchronization controller 526 included in the application processor 520 generates a frame start signal by counting the tearing effect control signal TE output from the display driver integrated circuit 540 based on the worst refresh rate of the display panel (i.e., indicated as DET). Subsequently, when the synchronization controller 526 provides the frame start signal to the timing controller 524 in the application processor 520, the timing controller 524 may provide the still image data IMI to the display driver integrated circuit 540 in synchronization with the frame start signal (i.e., at the worst refresh rate of the display panel). Here, the timing controller 524 may provide the display driver integrated circuit 540 with the control signals FSS for performing the refresh operation for the still image.

As described above, the display panel controller 500 may include the synchronization controller 526 that controls a frame synchronization of the display panel. Thus, even though the display driver integrated circuit 540 does not include a frame memory device, the display panel controller 500 may efficiently adjust the frame rate of the display panel. For convenience of description, the application processor 520 and the display driver integrated circuit 540 are simplified in FIGS. 11 through 12B. That is, the application processor 520 may include other components as well as the central processing unit 522, the timing controller 524, and the synchronization controller 526. In addition, the display driver integrated circuit 540 may include a scan driver circuit, a data driver circuit, etc. Therefore, it should be understood that a structure of the display panel controller 500 in which the synchronization controller 526 is located in the application processor 520 is not limited to the structure of FIG. 11.

Figure 13:
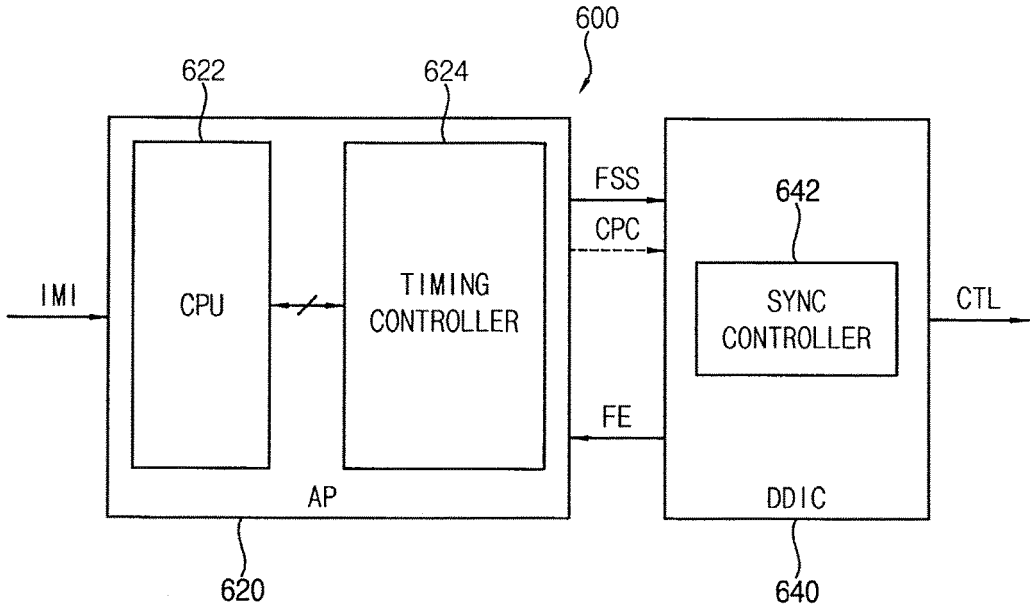
FIG. 13 is a block diagram illustrating an example of the display panel controller of FIG. 2 according to an exemplary embodiment of the inventive concept.
Figure 14A:
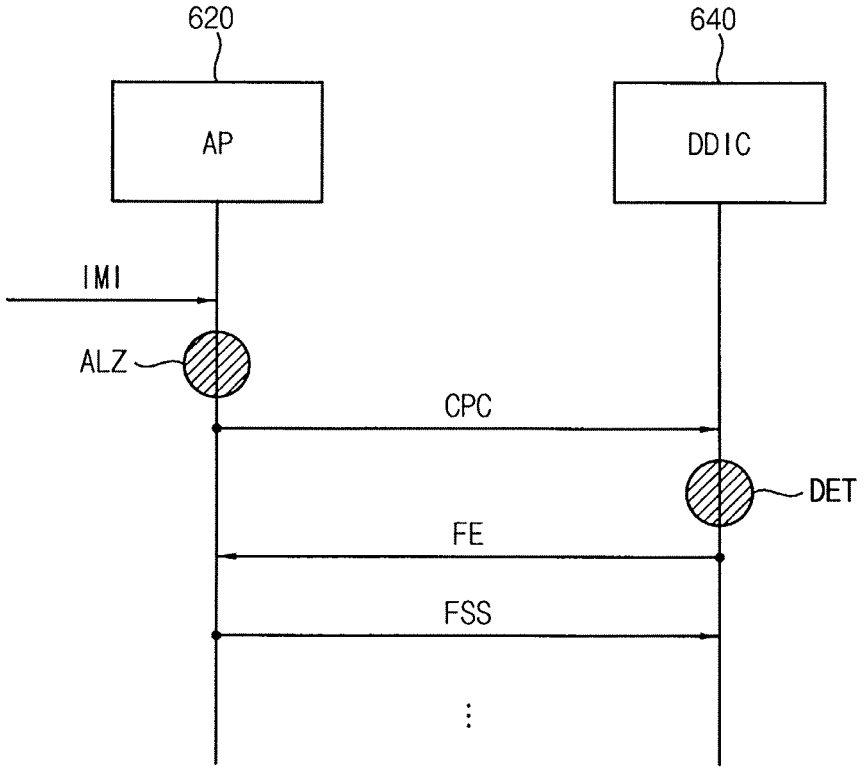
FIG. 14A is a diagram illustrating an example in which a frame rate of a display panel is adjusted by the display panel controller of FIG. 13.
Figure 14B:
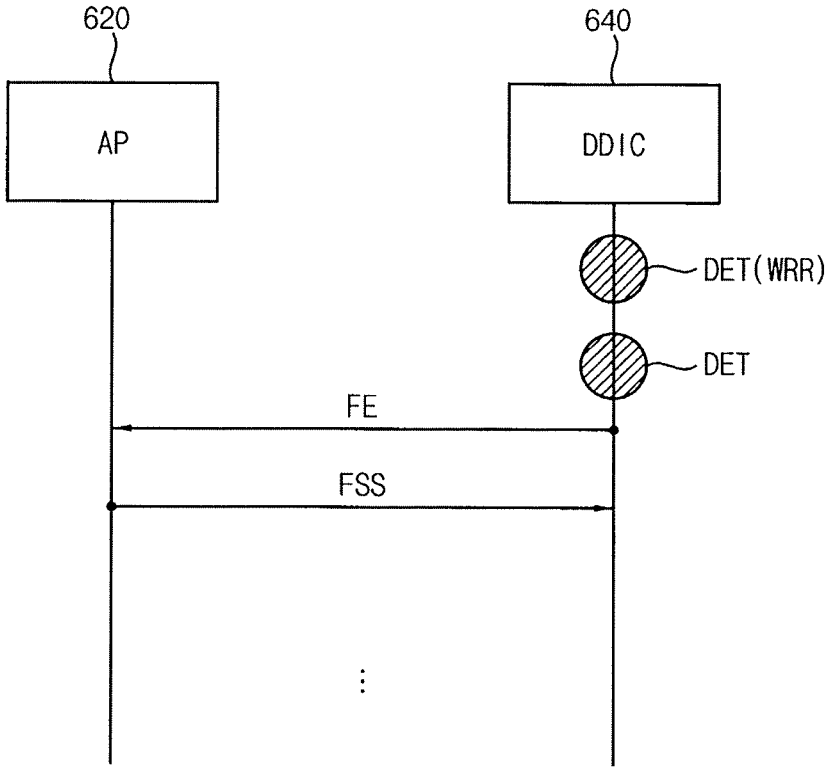
FIG. 14B is a diagram illustrating an example in which a frame rate of a display panel is adjusted by the display panel controller of FIG. 13.

FIG. 13 is a block diagram illustrating an example of the display panel controller of FIG. 2 according to an exemplary embodiment of the inventive concept. FIG. 14A is a diagram illustrating an example in which a frame rate of a display panel is adjusted by the display panel controller of FIG. 13. FIG. 14B is a diagram illustrating another example in which a frame rate of a display panel is adjusted by the display panel controller of FIG. 13.

Referring to FIGS. 13 through 14B, the display panel controller 600 includes an application processor 620 and a display driver integrated circuit 640. Here, the application processor 620 includes a central processing unit 622 and a timing controller 624. In addition, the display driver integrated circuit 640 includes a synchronization controller 642. That is, the synchronization controller 642 is located in the display driver integrated circuit 640.

The synchronization controller 642 included in the display driver integrated circuit 640 controls a frame synchronization of the display panel based on a minimum refresh rate of the display panel. In this exemplary embodiment, the display panel controller 600 does not include an image analyzer that determines the minimum refresh rate of the display panel by analyzing the still image data IMI and display characteristics of the display panel. Thus, the minimum refresh rate of the display panel is determined to be a worst refresh rate of the display panel. For example, the worst frame rate may be a predefined parameter stored within the display driver integrated circuit 640. The parameter may be set at the minimum frame rate that is still likely to prevent a screen tearing where the display panel 120 shows information from two or more frames in a single screen draw. The parameter may be different for different types of displays. Alternatively, the minimum refresh rate of the display panel may be determined by the central processing unit 622 included in the application processor 620. First, the central processing unit 622 may control the still image data IMI to be transferred from an external memory device to the timing controller 624. Thus, the timing controller 624 may provide the still image data IMI to the display driver integrated circuit 640 to display a still image on the display panel.

In an exemplary embodiment, as illustrated in FIG. 14A, when the still image data IMI is transferred from the external memory device to the application processor 620, the central processing unit 622 included in the application processor 620 determines the minimum refresh rate of the display panel by analyzing the still image data IMI and the display characteristics of the display panel (i.e., indicated as ALZ), and then provides a refresh rate signal CPC indicating the minimum refresh rate of the display panel to the synchronization controller 642 included in the display driver integrated circuit 640. Next, the synchronization controller 642 included in the display driver integrated circuit 640 generates a frame enable signal FE based on the minimum refresh rate of the display panel (i.e., indicated as DET), and then provides the frame enable signal FE as a frame start signal to the application processor 620 (i.e., the timing controller 624 of the application processor 620). Here, since the frame enable signal FE includes adjacent clocks each being spaced apart from one another by a distance corresponding to the minimum refresh rate of the display panel, the frame enable signal FE may be provided to the timing controller 624 as the frame start signal. Subsequently, the timing controller 624 included in the application processor 620 may provide the still image data IMI to the display driver integrated circuit 640 in synchronization with the frame start signal corresponding to the frame enable signal FE (i.e., at the minimum refresh rate of the display panel). Here, the timing controller 624 may provide the display driver integrated circuit 640 with a plurality of control signals FSS for performing a refresh operation for the still image.

In an exemplary embodiment, as illustrated in FIG. 14B, the minimum refresh rate of the display panel is determined to be the worst refresh rate of the display panel (i.e., indicated as DET(WRR)). Thus, the synchronization controller 642 included in the display driver integrated circuit 640 generates the frame enable signal FE based on the worst refresh rate of the display panel (i.e., indicated as DET), and provides the frame enable signal FE as the frame start signal to the application processor 620 (i.e., the timing controller 624 included in the application processor 620). Here, since the frame enable signal FE includes adjacent clocks each spaced apart from one another by a distance corresponding to the minimum refresh rate of the display panel, the frame enable signal FE may be provided to the timing controller 624 as the frame start signal. The frame start signal may indicate when a frame is to begin. For example, the synchronization controller 642 may generate the frame enable signal FE by skipping clocks corresponding to the worst refresh rate of the display panel on a tearing effect control signal. However, a method of generating the frame enable signal FE is not limited thereto. Subsequently, the timing controller 624 included in the application processor 620 may provide the still image data IMI to the display driver integrated circuit 640 in synchronization with the frame start signal corresponding to the frame enable signal FE (i.e., at the minimum refresh rate of the display panel). Here, the timing controller 624 may provide the display driver integrated circuit 640 with a plurality of control signals FSS for performing the refresh operation for the still image.

As described above, the display panel controller 600 may include the synchronization controller 642 that controls a frame synchronization of the display panel. Thus, even though the display driver integrated circuit 640 does not include a frame memory device, the display panel controller 600 may efficiently adjust the frame rate of the display panel. For convenience of description, the application processor 620 and the display driver integrated circuit 640 are simplified in FIGS. 13 through 14B. That is, the application processor 620 may include other components as well as the central processing unit 622 and the timing controller 624. In addition, the display driver integrated circuit 640 may include other components (e.g., a scan driver circuit, a data driver circuit, etc) as well as the synchronization controller 642. Therefore, it should be understood that a structure of the display panel controller 600 in which the synchronization controller 642 is located in the display driver integrated circuit 640 is not limited to the structure of FIG. 13.

Figure 15:
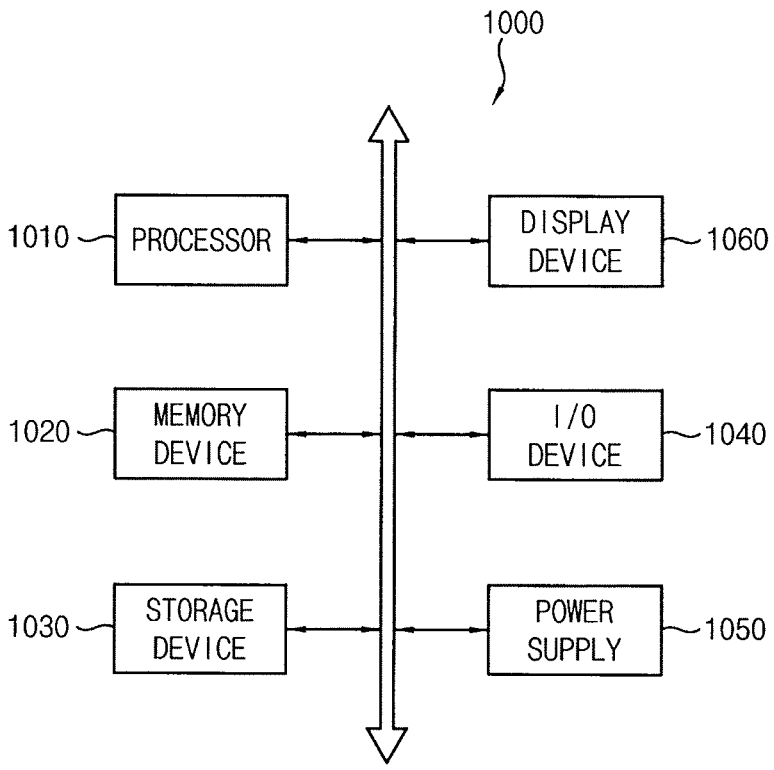
FIG. 15 is a block diagram illustrating an electronic device according to an exemplary embodiment of the inventive concept.
Figure 16:
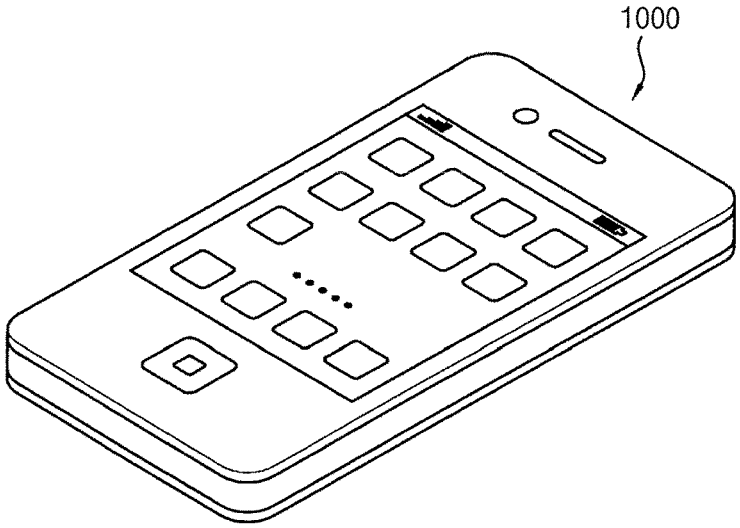
FIG. 16 is a diagram illustrating an example in which the electronic device of FIG. 15 is implemented as a smart phone.
Figure 17:
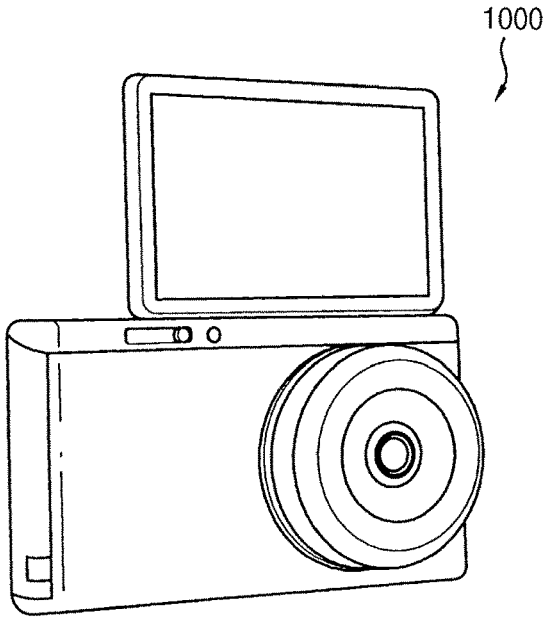
FIG. 17 is a diagram illustrating an example in which the electronic device of FIG. 15 is implemented as a digital camera.

FIG. 15 is a block diagram illustrating an electronic device according to an exemplary embodiment of the inventive concept. FIG. 16 is a diagram illustrating an example in which the electronic device of FIG. 15 is implemented as a smart phone. FIG. 17 is a diagram illustrating an example in which the electronic device of FIG. 15 is implemented as a digital camera.

Referring to FIGS. 15 through 17, the electronic device 1000 includes a processor 1010, a memory device 1020, a storage device 1030, an input/output (I/O) device 1040, a power supply 1050, and a display device 1060. Here, the display device 1060 may correspond to the display device 100 of FIG. 1. For example, the display device 1060 may be a liquid crystal display device, an organic light emitting display device, etc. In addition, the electronic device 1000 may further include a plurality of ports for communicating with a video card, a sound card, a memory card, a universal serial bus (USB) device, other electronic devices, etc. In an exemplary embodiment, as illustrated in FIG. 16, the electronic device 1000 may be implemented as a smart phone. In another exemplary embodiment, as illustrated in FIG. 17, the electronic device 1000 may be implemented as a digital camera (e.g., a mirror-less digital camera). However, the electronic device 1000 is not limited thereto. That is, the electronic device 1000 may be any electronic device including the display device 1060. For example, the electronic device 1000 may be implemented as a cellular phone, a smart pad, a personal digital assistant (PDA), a portable multimedia player (PMP), etc.

The processor 1010 may perform various computing functions. The processor 1010 may be a micro processor, a central processing unit (CPU), an application processor, etc. The processor 1010 may be coupled to other components via an address bus, a control bus, a data bus, etc. Further, the processor 1010 may be coupled to an extended bus such as a peripheral component interconnection (PCI) bus. The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 1030 may be a solid state drive (SSD) device, a hard disk drive (HDD) device, a CD-ROM device, etc.

The I/O device 1040 may be an input device such as a keyboard, a keypad, a mouse device, a touchpad, a touchscreen, a remote controller, etc, and an output device such as a printer, a speaker, etc. In an exemplary embodiment, the display device 1060 is located within the I/O device 1040. The power supply 1050 may provide power for operations of the electronic device 1000. The display device 1060 may be coupled to other components via the buses or other communication links. As described above, the display device 1060 may operate at low power by minimizing (or, reducing) power consumption when displaying a still image. To this end, a display panel controller of the display device 1060 may include an image analyzer that analyzes a minimum refresh rate of a display panel and a synchronization controller that controls a frame synchronization of the display panel, where each of the image analyzer and the synchronization controller is included in an application processor or in a display driver integrated circuit, or may include the synchronization controller that controls the frame synchronization of the display panel, where the synchronization controller is included in the application processor or in the display driver integrated circuit. Thus, the display panel controller of the display device 1060 may efficiently adjust (or, decrease) a frame rate of the display panel, where a central processing unit included in the application processor does not engage in controlling the frame rate of the display panel, and the display driver integrated circuit does not include a frame memory device.

Specifically, the display device may include an Indium-Gallium-Zinc-Oxide (IGZO) display panel, a display driver integrated circuit that drives the IGZO display panel to display a still image at a predetermined frame rate, an application processor that provides the display driver integrated circuit with still image data for implementing the still image and a plurality of control signals generated by a timing controller, and a synchronization controller that controls a frame synchronization of the IGZO display panel based on a minimum refresh rate of the IGZO display panel. Here, the synchronization controller may be located in the application processor or in the display driver integrated circuit. In an exemplary embodiment, the display device 1060 further includes an image analyzer that determines the minimum refresh rate by analyzing the still image data and display characteristics of the IGZO display panel. In an exemplary embodiment, the synchronization controller is located in the application processor, and the image analyzer is located in the display driver integrated circuit. In an exemplary embodiment, the synchronization controller and the image analyzer are both located in the display driver integrated circuit. In san exemplary embodiment, the synchronization controller and the image analyzer are both located in the application processor.

At least one embodiment of the present inventive concept may be applied to a display device and an electronic device including the display device. For example, the present inventive concept may be applied to a computer, a laptop, a digital camera, a cellular phone, a smart phone, a video phone, a smart pad, a tablet PC, a personal digital assistants (PDA), a portable multimedia player (PMP), a car navigation system, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the present inventive concept. Accordingly, all such modifications are intended to be included within the scope of the present inventive concept.

What is claimed is:

1. A display panel controller comprising:

a display driver integrated circuit configured to drive a display panel;

an application processor configured to provide the display driver integrated circuit with image data and a plurality of control signals generated by a timing controller;

an image analyzer determining a minimum refresh rate supported by the display panel by analyzing the image data and display characteristics of the display panel; and a synchronization controller configured to control a frame synchronization of the display panel based on the determined minimum refresh rate of the display panel, wherein the determining comprises:

decreasing a first refresh rate of the display panel to a second refresh rate when the display characteristics indicate the display panel is an Indium-Gallium-Zinc-Oxide display panel and the image data is still image data for implementing a still image; and setting the minimum refresh rate to the second refresh rate.

2. The display panel controller of claim 1, wherein the synchronization controller is located in the application processor and the image analyzer is located in the display driver integrated circuit.

3. The display panel controller of claim 2, wherein the image analyzer provides the synchronization controller with a refresh rate signal indicating the minimum refresh rate, and wherein the synchronization controller generates a frame start signal by counting a tearing effect control signal output from the display driver integrated circuit based on the minimum refresh rate and provides the frame start signal to the timing controller.

4. The display panel controller of claim 1, wherein the image analyzer and the synchronization controller are located in the display driver integrated circuit.

5. The display panel controller of claim 4, wherein the image analyzer provides the synchronization controller with a refresh rate signal indicating the minimum refresh rate, and wherein the synchronization controller generates a frame enable signal based on the minimum refresh rate and provides the frame enable signal as a frame start signal to the timing controller.

6. The display panel controller of claim 1, wherein the image analyzer and the synchronization controller are located in the application processor.

7. The display panel controller of claim 6, wherein the image analyzer provides the synchronization controller with a refresh rate signal indicating the minimum refresh rate, and wherein the synchronization controller generates a frame start signal by counting a tearing effect control signal output from the display driver integrated circuit based on the minimum refresh rate and provides the frame start signal to the timing controller.

8. The display panel controller of claim 1, wherein the synchronization controller is located in the display driver integrated circuit.

9. The display panel controller of claim 8, wherein the synchronization controller generates a frame enable signal based on the minimum refresh rate and provides the frame enable signal as a frame start signal to the timing controller.

10. The display panel controller of claim 1, wherein the synchronization controller is located in the application processor.

11. The display panel controller of claim 10, wherein the synchronization controller generates a frame start signal by counting a tearing effect control signal output from the display driver integrated circuit based on the minimum refresh rate and provides the frame start signal to the timing controller.

12. A display device comprising:

the display panel controller of claim 1; and the display panel.

13. The display device of claim 12, wherein the display panel is an Indium-Gallium-Zinc-Oxide (IGZO) display panel.

14. The display panel controller of claim 1, wherein the determining sets the minimum refresh rate to the first refresh rate when the image data is moving image data for implementing a moving image.

15. The display panel controller of claim 1, wherein the minimum refresh rate is a lowest refresh rate that prevents the display panel from showing two frames in a single screen draw.

16. A display panel controller comprising:

an application processor configured to provide image data based on a frame start signal and timing control signals;

a display driver integrated circuit determining a minimum refresh rate supported by a display panel by analyzing both image data within the image data received from the application processor and display characteristics of the display panel and provide the image data and the timing control signals to the display panel; and a synchronization controller configured to generate the frame start signal based on the determined minimum refresh rate and provide the frame start signal to the application processor, wherein the determining comprises:

decreasing a first refresh rate of the display panel to a second refresh rate when the display characteristics indicate transistors of the display panel are Indium-Gallium-Zinc-Oxide transistors and the image data is still image data for implementing a still image; and setting the minimum refresh rate to the second refresh rate.

17. The display panel controller of claim 16, wherein a central processing unit of the application processor does not engage in controlling a frame rate of the display panel and the display driver integrated circuit does not include a frame memory device.

18. The display panel controller of claim 16, wherein the synchronization controller generates the frame start signal by counting a tearing effect control signal output from the display driver integrated circuit based on the determined minimum refresh rate.

19. The display panel controller of claim 16, wherein the determining sets the minimum refresh rate to the first refresh rate when the image data is moving image data for implementing a moving image.

20. The display panel controller of claim 16, wherein the minimum refresh rate is a lowest refresh rate that prevents the display panel from showing two frames in a single screen draw.

* * * * *